US006281443B1

(12) United States Patent
Idler

(10) Patent No.: US 6,281,443 B1
(45) Date of Patent: Aug. 28, 2001

(54) ELECTRICAL CABLE

(76) Inventor: Erik J. Idler, 16 Bay Rd., Huntington, NY (US) 11743

( * ) Notice: Subject to any disclaimer, the term of this patent is extended or adjusted under 35 U.S.C. 154(b) by 0 days.

(21) Appl. No.: 09/417,334

(22) Filed: Oct. 13, 1999

(51) Int. Cl.[7] ..... H01B 7/00

(52) U.S. Cl. ..... 174/110 R; 174/113 R; 174/115

(58) Field of Search ..... 174/110 R, 113 R, 174/114 R, 115, 36

(56) References Cited

U.S. PATENT DOCUMENTS

| | | | | |
|---|---|---|---|---|
| 3,715,458 | * | 2/1973 | Bayes et al. | 174/113 R |
| 3,833,755 | * | 9/1974 | Soelberg | 174/117 F |
| 4,234,759 | * | 11/1980 | Harlow | 174/104 |
| 4,313,029 | * | 1/1982 | Burnish | 174/115 |
| 4,467,138 | * | 8/1984 | Brorein | 174/115 |
| 4,487,997 | * | 12/1984 | Ditchfield | 174/115 |
| 4,578,529 | | 3/1986 | Look | 174/117 |
| 4,638,117 | * | 1/1987 | Ney | 174/117 F |
| 4,698,457 | | 10/1987 | Bordbar | 174/36 |
| 4,933,513 | * | 6/1990 | Lee | 174/115 |
| 4,963,222 | | 10/1990 | Borjour et al. | 156/393 |
| 5,218,167 | | 6/1993 | Gasque, Jr. | 174/37 |
| 5,554,825 | | 9/1996 | Parker et al. | 174/117 |
| 5,565,653 | * | 10/1996 | Rofidal et al. | 174/113 R |
| 5,864,094 | | 1/1999 | Griffin | 174/105 |

* cited by examiner

*Primary Examiner*—Dean A. Reichard
*Assistant Examiner*—William H Mayo, III
(74) *Attorney, Agent, or Firm*—Island Patent Associates

(57) ABSTRACT

An improved electrical cable includes a number of insulated electrical conductors, which are closely spaced and parallel to each other, and frangibly joined along their respective longitudinal lengths by insulation of each insulated conductor. Also included is an uninsulated conductor that is embedded within, at least in part, and contacting insulation that is frangibly joining the insulated conductors. The electrical cable is specifically structured so that when a frangibly joined insulated conductor is separated from one or more other insulated conductors, the uninsulated conductor is exposed or released.

20 Claims, 4 Drawing Sheets

ELECTRICAL CABLE

BACKGROUND OF THE INVENTION

1. Field of the Invention

The present invention relates to electrical wires and cables. More particularly, the invention relates to an improved electrical cable including at least two insulated conductors, and an embedded uninsulated additional conductor that is exposed or released when at least one insulated conductor of the invention is separated from at least one other insulated conductor.

2. Description of the Prior Art

A large variety of cables and cable assemblies are known in the art. Cables may be categorized into two fundamental classes: custom (constructed) cables or off-the-shelf cables. A custom cable, or possibly more properly a custom cable assembly, is often constructed having a plurality of individual insulated conductors, and possibly includes other uninsulated (grounding or shielding) conductors. Custom cables may be wrapped or housed within a sheathing means, or alternately, devices such as tie-wraps and shrink tubing may be employed.

In the case of off-the-shelf cables or cable assemblies, such as common lamp-type chord, Romex, or BX cable, a fixed plurality of insulated and possibly uninsulated conductors are available. As such, an electrical contractor will select a specific off-the-shelf cable based on the requirements of an installation. Importantly, local and state codes often specify one or more standard off-the-shelf cables to be used for respective electrical installations and connections.

Hanging lamps and lighting fixtures represent a common type of installation wherein electricians have to deal with two, sometimes conflicting issues. First, the installation must be safe and meet local electrical codes. Typically, the wiring of such fixtures involves the use of lamp-type chord, also well known as 'zip-chord' or 'lamp chord'. This type of electrical cable, which may be considered an off-the-shelf cable assembly, is formed of two juxtaposed, closely spaced and parallel, insulated conductors that are frangibly joined. As skilled persons will understand, lamp chord is structured to enable the joined insulated conductors to be readily separated, as required, while leaving the insulation of each of the separated insulated conductors intact. In addition, many local electrical codes require a fixed safety ground on the hanging lamp portion of the lighting fixture. This is typically realized by running a wire from the hanging fixture to a suitable location to connect to earth ground. Accordingly, electricians and electrical contractors must include a third conductor. Very often, the third conductor is provided by lamp manufacturers as an unsightly bare electrical conductor having a silver or gold coloration. Alternately, an additional insulated wire may be added to the lamp chord cable, if local electrical codes allow the use of an insulated wire. Either solution, as well as others that may be possible, provides for a less than antiseptic solution. This leads to the second issue facing the electrical contractor: customer satisfaction. When properly wired with a lamp chord (say of a black color), with an uninsulated ground wire, a fixture's installation is safe and meets the code, but may appear quite unsightly. Customers have been known to complain about the appearance of such an installation, and as a result, the ground wire is sometimes removed—either by the contractor, or later by the resident.

Therefore, there is a need to provide new and improved off-the-shelf cables, or cable assemblies and configurations, having one or more of the following capabilities, features, characteristics, and or advantages:

- an electrical cable having a plurality of insulated frangibly joined electrical conductors;
- includes at least one uninsulated conductor that is at least partially housed within the electrical cable by at least a portion of the insulation that is insulating the frangibly joined insulated conductors;
- provides for the release of the uninsulated conductor when at least one of the insulated conductors is separated from at least one other insulated conductor;
- simple, cost effective cable structure; and
- may be economically fabricated and provided in traditional cable spools or rolls.

The above listed capabilities, characteristics, and or associated novel features of the present invention, as well as others, will become more apparent from a careful review of the description and figures provided herein. Attention is called to the fact, however, that the drawings and descriptions are illustrative only. Variations are contemplated as being part of the invention, limited only by the scope of the appended claims.

SUMMARY OF THE INVENTION

In accordance with the present invention, an electrical cable includes a plurality of juxtaposed (closely spaced and parallel) individually insulated conductors. The insulated conductors are frangibly coupled together along the longitudinal length of the conductors by a suitable frangible coupling arrangement. This frangible coupling is preferably provided, at least in part, by portions of the insulation of the respective insulated conductors. The electrical cable, which may be termed a cable assembly, further includes an additional uninsulated conductor, which is electrically isolated from each of the plurality of insulated conductors. The additional uninsulated conductor is suitably encased within portions of the insulation of at least two of the plurality of insulated conductors included with a respective embodiment of the invention. Preferred embodiments of the invention are contemplated to include 2 or more insulated electrical conductors.

Importantly, the electrical cable is structured to release or expose, at least partially, the uninsulated conductor when at least one of the insulated conductors is separated from at least one other insulated conductor. In a most preferred embodiment of the electrical cable of the present invention the cable is formed of two insulated conductors, with the uninsulated conductor situated substantially between and parallel to each of the insulated conductors. Accordingly, when considering an end or cross sectional view of the cable assembly, the insulated and uninsulated conductors would each preferably be substantially in-line or in the same plane. In addition, the most preferred embodiments of the invention will provide each of the insulated and uninsulated conductors as a multi-strand conductor, with the uninsulated conductor possibly tinned to prevent or minimize separating of the strands thereof during and after installation. It is further contemplated that the present invention may be dispensed or provided to skilled persons as a pre-defined length of cable, suitably coiled upon a support means such as a traditional wire spool.

BRIEF DESCRIPTION OF THE DRAWINGS

In the drawings, like elements are assigned like reference numerals. The drawings are not necessarily to scale, with the emphasis instead placed upon the principles of the present invention. Additionally, each of the embodiments depicted are but one of a number of possible arrangements utilizing the fundamental concepts of the present invention. The drawings are briefly described as follows.

PARTIAL LIST OF REFERENCE NUMERALS

10*a*, 10*b*—electrical cable
14*a*, 14*b*—insulated (electrical) conductors
16*a*, 16*b*—respective conductors of 14*a* and 14*b*
18—uninsulated conductor
22*a*, 22*b*—insulation of insulated conductors
22*a*, 22*b*—web portions or webbing
30—roll-type holder or spool
32—coils of electrical cable 10 upon 30
34—center-line

DETAILED DESCRIPTION OF THE INVENTION

It is important to establish the definition of several terms and or expressions that will be used throughout this disclosure. The term 'electrical conductor', which may apply to, or be associated with, an insulated or uninsulated conductor or single cable, may be assumed to indicate any common solid or multi-strand electrical conductor suitable for a variety of electrical applications. The terms 'frangible', 'frangibly', and other like terms employed herein, especially when referring to the coupling or attachment of one insulated conductor to at least one other insulated conductor of the cable, may be assumed to indicate that the conductors are joined or coupled so that an individual may easily separate at least one insulated conductor from at least one other insulated conductor. However, it must be understood that a suitable frangible coupling may actually require an individual to employ one or more simple hand tools to aid in the separating of respective insulated conductors. Other important terms and associated definitions will be provided as they are needed in the following sections.

Figure 1A:
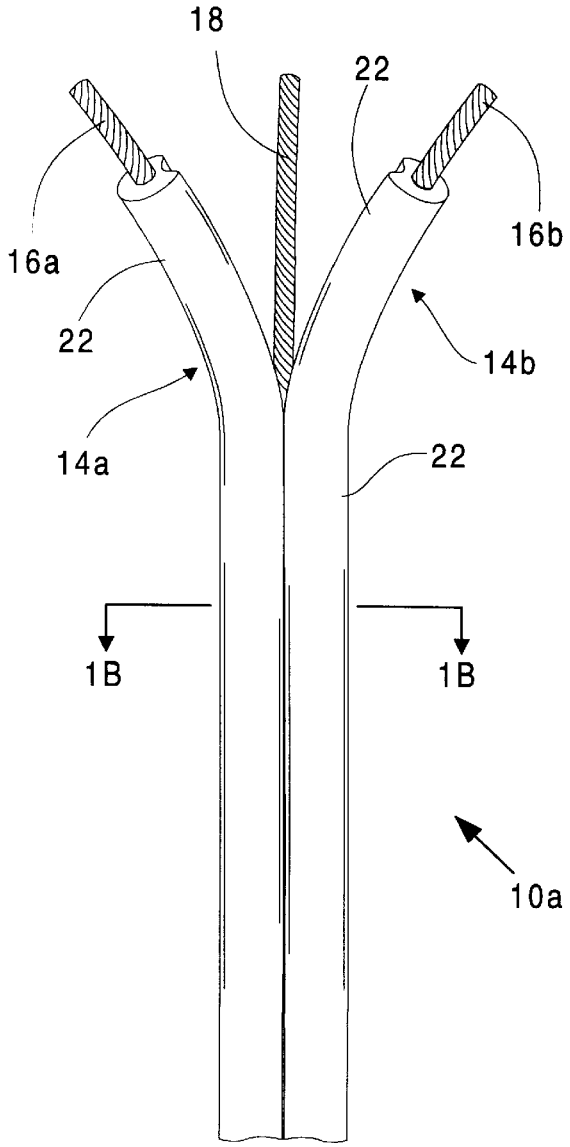
FIGS. 1A and 1B depict a first embodiment of an electrical cable in accordance with the present invention.
Figure 1B:
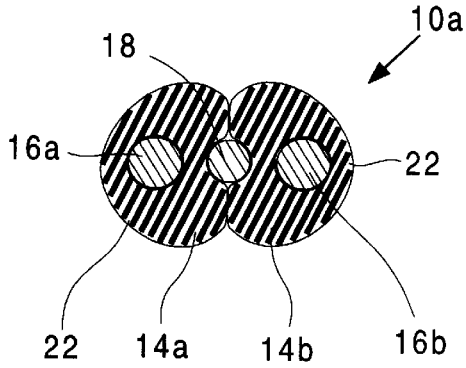

Referring now to FIGS. 1A and 1B, there is illustrated a first embodiment of an electrical cable 10*a* in accordance with the present invention. The electrical cable 10*a* is structured having a plurality of juxtaposed individually insulated conductors, such as conductors 14*a* and 14*b*.

For simplicity and clarity, when referring in a general fashion to a plurality of an item, such the insulated conductors 14*a* and 14*b*, the base reference numeral (i.e., 14) will be employed. Similarly, the designation 10 may be used to indicate any or all of the possible embodiments of the electrical cable 10*a*, 10*b*, and 10*c*, and equivalents (as determined by the context in which it is used).

Returning to FIGS. 1A and 1B, the plurality of juxtaposed insulated conductors 14, which may be described as closely spaced and parallel to each other along their respective longitudinal lengths, are configured to be frangibly coupled together. As can be seen therein, the frangible coupling of the insulated conductors 14 is preferably provided, either partially or completely, by a suitable (frangible) joining of portions of the insulation 22 of the insulated conductor 14*a* with portions of the insulation 22 of the insulated conductor 14*b*. Further included with the electrical cable of the present invention, such as cable 10*a*, is an additional uninsulated conductor 18, which is electrically isolated from each of the plurality of insulated conductors 14.

The additional uninsulated conductor 18 is contemplated to be substantially if not totally encased within portions of the insulation 22 of at least two of the plurality of insulated conductors. For example, as illustrated in FIG. 1B, proximate portions of the insulation 22 of the insulated conductors 14 may be arranged to completely encase the uninsulated conductor 18, while also frangibly coupling the conductors 14*a* and 14*b*. In addition, the electrical cable 10*a* may preferably be structured to release the uninsulated conductor 18 when at least one of the plurality of the frangibly joined insulated conductors 14 are separated from at least one other insulated conductor. For example, when considering the embodiments of the invention depicted in FIG. 1A though FIG. 4, when a portion (or length) of the insulated conductor 14*a* is separated from insulated conductor 14*b*, the uninsulated conductor 18 is exposed, with a portion of the length thereof possibly released for use as required. It may also be noted that the embodiment of the electrical cable 10*a* is most preferably structured with the uninsulated conductor 18 situated substantially between and parallel to each of the insulated conductors 14*a* and 14*b*. As such, this arrangement may be described as having all three conductors 16*a*, 18, and 16*b*, arranged in an in-line fashion or situated substantially within a common (geometric) plane.

It should be noted that the illustrations of the present disclosure have been provided showing two insulated conductors in order to not obfuscate the present invention, and to further illustrate several of the most preferred embodiments of the invention. However, it must be understood that embodiments may certainly be provided with more that two insulated conductors, and it is contemplated that such embodiments may be provided by skilled persons who have read and fully understand the subject matter of the present invention as disclosed herein.

Figure 2A:
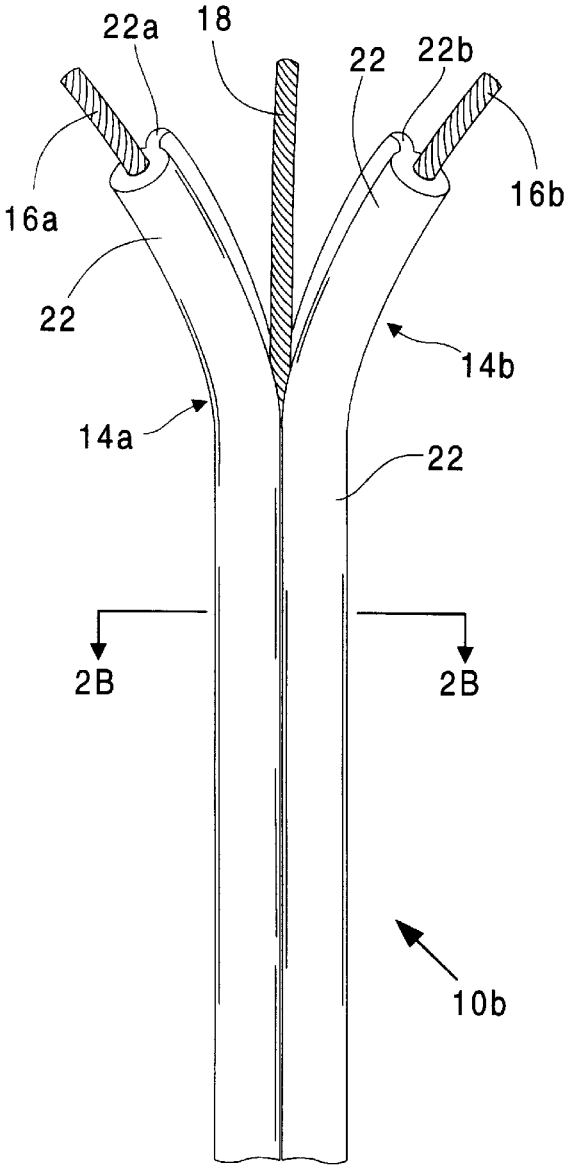
FIGS. 2A and 2B provide an alternate embodiment to the embodiment of FIG. 1A.
Figure 2B:
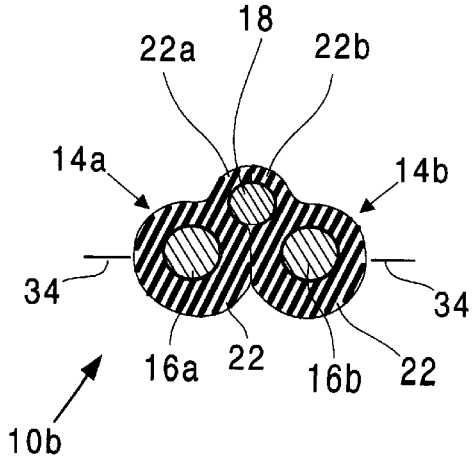

Turning now to FIGS. 2A and 2B, a second preferred embodiment of the electrical cable 10*b* of the invention is depicted. The electrical cable 10*b* is structured having the uninsulated conductor 18 slightly off-center from a center line 34, as clearly seen in FIG. 2B. Recall, electrical cable 10*a* was structured with the uninsulated conductor most preferably provided in-line with (i.e. with a common plane with) and substantially between insulated conductors 14*a* and 14*b*. In contrast, as clearly illustrated in FIGS. 2A and 2B, the electrical conductor 10*b* is configured with the uninsulated conductor 18 slightly removed from or offset from a plane formed by and containing the juxtaposed insulated conductors 14*a* and 14*b*. Alternately, this offset arrangement of uninsulated conductor 18 may be described as being displaced from a center line 34 extending between the insulated conductors 14*a* and 14*b*.

As can be seen FIGS. 2A and 2B, the uninsulated conductor 18 is partially encased by the insulation 22 of each insulated conductor 14. The actual physical encasing of the uninsulated conductor 18 within electrical cable 10*b* is completed by an additional webbing or web portion(s), such as web portions 22*a* and 22*b*. As illustrated, the frangible coupling of the insulated conductors 14 of this embodiment is realized by a suitable coupling of the insulation 22 of insulated conductor 14*a* and insulation 22 of the insulated conductor 14*b* on a 'first side' of the uninsulated conductor 18, with the frangible coupling of insulation webbing portions, such as 22*a* and 22*b*, provided preferably on the diametrically opposing or opposite side of the uninsulated conductor 18 (see FIG. 2B). Accordingly, the uninsulated conductor 18 may be said to be encased, at least partially, within the insulation frangibly jointing the insulated conductors 14*a* and 14*b*.

As implied by illustrations of FIGS. 1A through 3B, the electrical cables 10*a*, 10*b* and 10*c* of the present invention, as well as equivalents, may be configured with one or more cables 16*a*, 18, and 16*b* provided as multi-strand (i.e., stranded) conductors. In addition, in a possibly most preferred embodiment of the present invention one or more of the conductors 16, and or the uninsulated conductor 18 may be 'tinned'. As skilled persons would appreciate, tinning is applied to wires for a number of reasons including stiffening a stranded cable, providing a conductor that may be easily soldered, and or preventing the individual strands from separating and raveling.

Figure 3A:
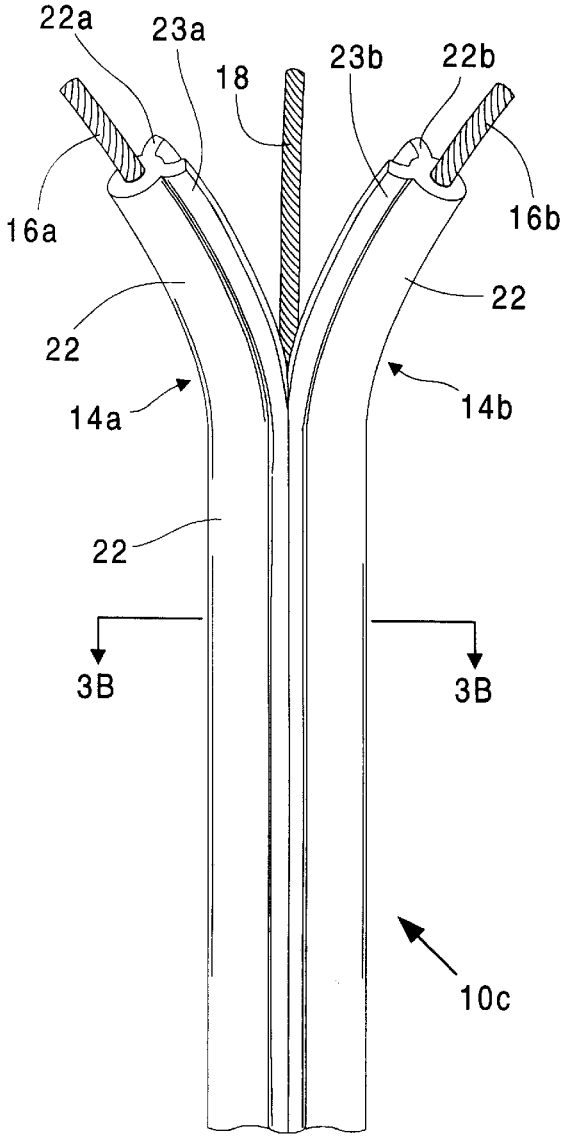
FIGS. 3A and 3B illustrate yet another possible embodiment of the electrical cable of the present invention.
Figure 3B:
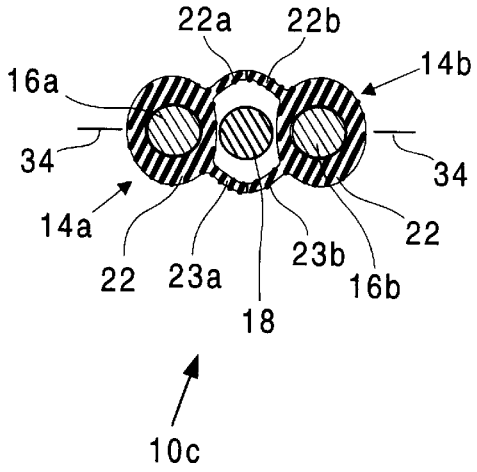
Figure 4:
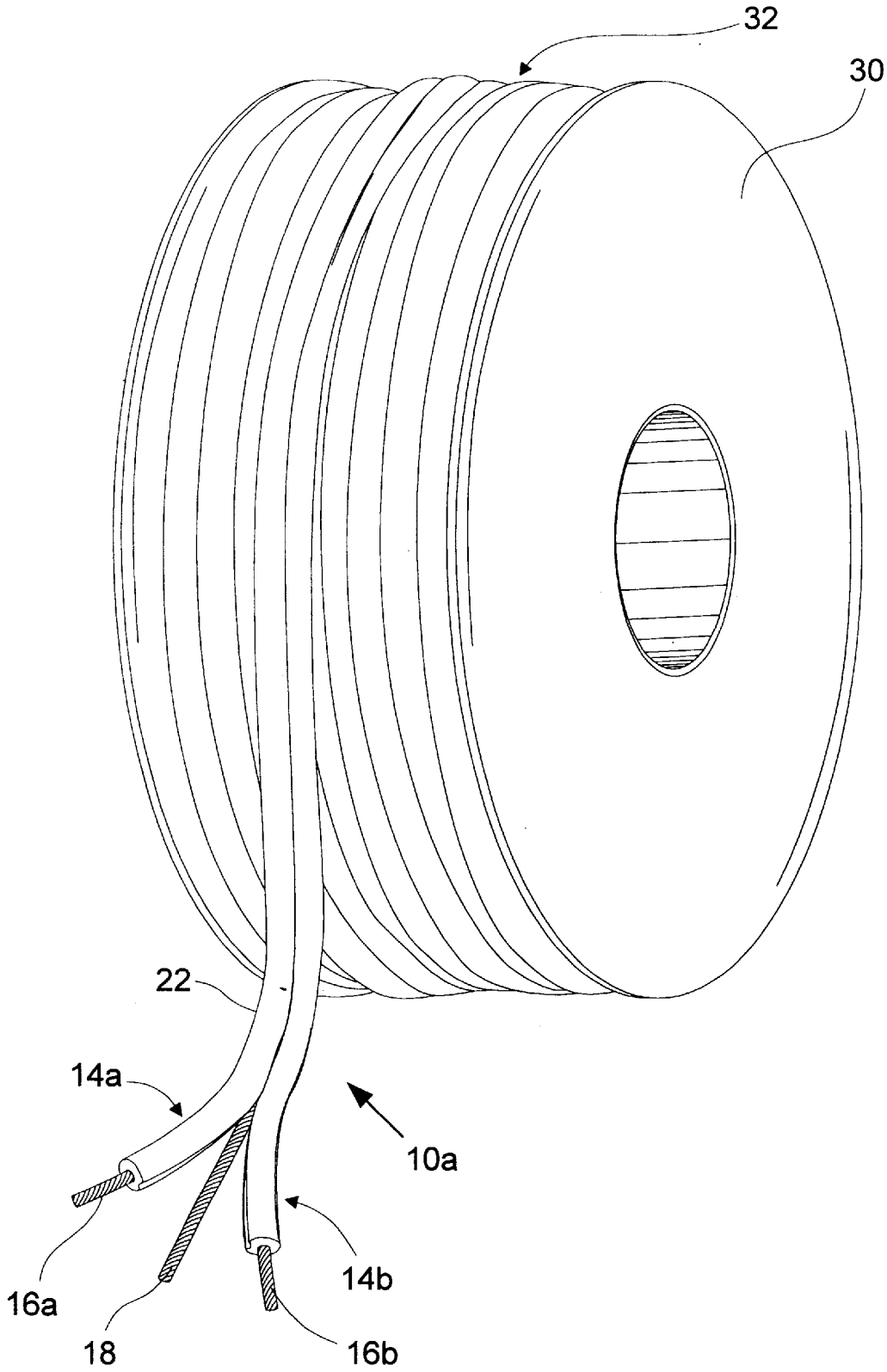
FIG. 4 provides a perspective view of a pre-defined length of the embodiment of the electrical cable shown in FIG. 1A depicted coiled upon a roll-type holder or spool.

While a plurality of the currently preferred embodiments of the present invention have been described and illustrated, skilled persons will appreciate a number of additional embodiments that may be provided. For example, as shown in FIGS. 3A and 3B, additional webbing portions 23*a* and 23*b* may be included to provide additional means to encase the uninsulated (center) conductor 18. As shown, this embodiment may employ a plurality of symmetric web portions 22*a*, 22*b*, 23*a*, and 23*b*, to encase the uninsulated conductor 18—while enabling the in-line arrangement of the FIG. 1A embodiment to be realized. Further, as depicted in FIG. 4, it is contemplated that the electrical cable of the present invention may be packaged in a substantial and pre-defined length, with the cable 10 coiled upon a support means, such as the roll-type holder 30, which may alternately be termed a 'spool' or 'cable spool'. Finally, as it is contemplated that the electrical cable 10 will preferably be structured for interior use with insulation of the insulated conductors being flexible and providing a durable and substantially limber electrical cable—as is common with many lamp-type electrical cables.

What is claimed is:

1. An electrical cable, comprising:

(a) a plurality of individual juxtaposed insulated conductors;

(b) the plurality of juxtaposed insulated conductors being frangibly coupled together along a longitudinal length of the juxtaposed insulated conductors, by a frangible coupling of insulation of each of the juxtaposed insulated conductors; and (c) an additional uninsulated conductor, which is electrically isolated from a conductor of each of the plurality of juxtaposed insulated conductors, the additional uninsulated conductor encased within and contacting portions of the insulation of at least two of the plurality of insulated conductors;

(d) the electrical cable structured to release the uninsulated conductor when at least one frangibly coupled juxtaposed insulated conductor is separated from at least one other juxtaposed insulated conductor.

2. The electrical cable in accordance with claim 1, wherein the electrical cable consists of two insulated conductors.

3. The electrical cable in accordance with claim 2, wherein the electrical cable is provided in a substantial length coiled upon a support means.

4. The electrical cable in accordance with claim 2, wherein the uninsulated conductor is situated substantially between and oriented parallel to each of the insulated conductors.

5. The electrical cable in accordance with claim 4, wherein each of the juxtaposed insulated conductors, and the uninsulated conductor is a multi-strand conductor.

6. The electrical cable in accordance with claim 5, wherein the uninsulated multi-strand conductor is tinned.

7. An improved electrical cable including a pair of closely spaced insulated conductors that are frangibly coupled together along a longitudinal length of the insulated conductors by a joining of a portion of insulation of each insulated conductor situated substantially between the insulated conductors, the improved cable further including:

(a) an uninsulated conductor, which is electrically isolated from a conductor of each of the insulated conductors, the uninsulated conductor contacting and encased, at least partially, within insulation of the insulated conductors that is frangibly joining the pair of insulated conductors;

(b) the improved electrical cable structured to release and expose the uninsulated conductor as the pair of insulated conductors that are frangibly coupled are separated.

8. The improved electrical cable in accordance with claim 7, wherein the uninsulated conductor is situated substantially between and substantially parallel to each insulated conductors along a length of the cable.

9. The improved electrical cable in accordance with claim 7, wherein the uninsulated conductor is situated slightly removed from a portion of a plane formed by and containing the insulated conductors, with the uninsulated conductor encased partially by a portion of insulation of each insulated conductor, along with an additional web of insulation coupled to, and extending between each of the insulated conductors, thereby covering and encasing the uninsulated conductor.

10. The improved electrical cable in accordance with claim 9, wherein each of the insulated conductors and the uninsulated conductor is a multi-strand conductor.

11. The electrical cable in accordance with claim 10, wherein the uninsulated multi-strand conductor is tinned.

12. The improved electrical cable in accordance with claim 10, wherein electrical cable is structured for interior use with insulation of the insulated conductors being flexible and providing a durable and substantially limber electrical cable.

13. The improved electrical cable in accordance with claim 7, wherein the electrical cable is provided in a substantial length coiled upon a support means for uncoiling and use as required.

14. The improved electrical cable in accordance with claim 7, wherein the uninsulated conductor is substantially between the two insulated conductors, and substantially parallel to each insulated conductors along a length of the cable, with a plurality of frangible webbing portions provided between the insulated conductors to encase the uninsulated conductor.

15. An electrical cable assembly suitable for use with hanging electrical lighting fixtures to provide power thereto while also providing a suitable safety grounding connection, the electrical cable assembly comprising:

(a) at least two closely spaced parallel insulated conductors;

(b) the insulated conductors being frangibly coupled together along a longitudinal length of the insulated conductors by a frangible coupling of insulation of each insulated conductor; and (c) an uninsulated conductor, which is electrically isolated from a conductor of each of the insulated conductors, the uninsulated conductor encased, at least partially within, and contacting portions of insulation of the insulated conductors; (d) the electrical cable assembly structured to expose and release the uninsulated conductor as at least one of the insulated conductors is separated from at least one other insulated conductor.

16. The electrical cable assembly in accordance with claim 15, wherein the electrical cable assembly consists of two insulated conductors, along with the uninsulated conductor.

17. The electrical cable assembly in accordance with claim 16, wherein the electrical cable assembly is provided in a predefined length coiled upon a support means.

18. The electrical cable assembly in accordance with claim 16, wherein the uninsulated conductor is situated substantially parallel to and between each of the insulated conductors.

19. The electrical cable assembly in accordance with claim 18, wherein the uninsulated conductor is a multi-strand conductor.

20. The electrical cable assembly in accordance with claim 19, wherein the uninsulated multi-strand conductor is tinned.

* * * * *